United States Patent [19]

Papst et al.

[11] 4,221,546

[45] Sep. 9, 1980

[54] AXIAL FAN

[75] Inventors: Georg Papst; Volker Schlicker, both of St. Georgen; Günter Wrobel, Villingen, all of Fed. Rep. of Germany

[73] Assignee: Pabst-Motoren KG, Fed. Rep. of Germany

[21] Appl. No.: 851,430

[22] Filed: Nov. 14, 1977

Related U.S. Application Data

[63] Continuation of Ser. No. 633,117, Nov. 18, 1975, abandoned.

[30] Foreign Application Priority Data

Nov. 18, 1974 [CH] Switzerland ..... 015298/74

[51] Int. Cl.[2] ..... F04D 25/08; F04D 29/44

[52] U.S. Cl. ..... 417/354; 415/207

[58] Field of Search ..... 417/354, 352, 353, 423 R; 415/210, 207, 213 C

[56] References Cited

U.S. PATENT DOCUMENTS

| | | | |
|---|---|---|---|
| 2,435,645 | 2/1948 | Bergstrom | 417/353 |
| 2,926,838 | 3/1960 | Van Rijn | 417/354 |
| 3,237,849 | 3/1966 | Krell | 417/353 X |
| 3,334,807 | 8/1967 | McMahan | 415/207 |
| 3,362,627 | 1/1968 | Papst | 417/354 |
| 3,378,192 | 4/1968 | Friese | 417/353 |
| 3,531,221 | 9/1970 | Herberg et al. | 417/354 |
| 4,061,188 | 12/1977 | Beck | 415/210 X |

*Primary Examiner*—Leonard E. Smith

*Attorney, Agent, or Firm*—Craig and Antonelli

[57] ABSTRACT

In an axial fan, the flow channel is constricted on the suction side in necked-down manner and is widened on the pressure side in diffuser-like manner. The electrical driving motor arranged in the center of the impeller has an overhung rotor, whose rotor shaft is supported in a punctiform bearing arranged on the suction side.

30 Claims, 9 Drawing Figures

AXIAL FAN

This is a continuation of application Ser. No. 633,117, filed Nov. 18, 1975, now adandoned.

BACKGROUND AND SUMMARY OF THE INVENTION

The invention relates to an axial fan, whose fan blades are fixed to the rotor of an electrical driving motor and are mounted coaxially within a pipe section and extend over at least half the axial length of the said pipe section, whereby the flow channel formed by the pipe section is constricted in the flow direction from a wide inlet on the suction side to a necked-down portion and from the latter is widened to a wide outlet on the pressure side.

Only a limited space is available for axial fans of this type and it is therefore a problem of the invention to obtain within the space a maximum delivery efficiency in practical operation, accompanied by a minimum noise development.

According to the invention, this problem is solved through the necked-down portion closely embracing the periphery of the blades and extending only over a small fraction of the axial length of the blades on the suction side and through the shaft of a rotor being mounted with axial clearance in pivot bearings and being supported on the suction side is supported on a punctiform bearing centrally arranged in a flanged wheel and through the flanged wheel being fixed with spokes to the suction side edge of the pipe section, whereby the said spokes span from the annular axial surface of projection of the blades hollowed out by the flanged wheel to the suction side edges of the blade and namely with such an orientation of the inclined position that the axial projection of the intersection point of the spokes with the edges are displaced outwardly during operation.

As a result of the invention, it is possible to obtain a relatively large pressure side extension of the flow channel in the limited space available and in this area it is also unnecessary to narrow down the flow channel through the elements necessary for the mounting support. This is achieved by the suction side arrangement of the axially short necked-down portion and the suction side arrangement of the flanged wheel and spokes necessary for the mounting. With the object of obtaining a high delivery efficiency, it is advantageous to make the blades sufficiently long in the axial direction that the whole space available in the flow channel within the pipe section is used to the maximum. If this is done, the rear edges of the blades slide past the spokes in close proximity thereto. The resulting noise can be avoided by the special inclined orientation of the spokes.

Thus, an axially wide extension on the pressure side (outlet), almost up to the safety clearance at the outlet plane $E_A$, which is made fully utilizable by the non-circular cross-sectional extension described hereinafter.

The suction side supported punctiform bearing of the rotor shaft provided in this connection has proved very unprone to wear in practical operation, because the reactive forces acting on the rotor shaft are directed towards the suction side and can be supported in such a punctiform bearing with extremely little friction. This bearing is particularly advantageous in cases where the fan is positioned to blow vertically upwards, thus, not only the reactive forces but also the weight of the rotor must be supported in the direction of the suction side.

This leads not only to a relatively long service life but also a relatively short start-up time.

According to a further development of the invention, the section side constriction of the flow channel takes place with a continuously decreasing pitch in the flow direction and the pressure side extension is in the form of a diffuser. The outlet of the flow channel is bounded by a polygonal contour in whose corner areas the outlet-side end portion of the flow channel projects beyond the circular periphery circumscribed by the polygonal contour. As a result of this further development, the flow channel cross-section is further improved within the existing volume relationships and in support of the pressure side extension it is also possible to utilize the corner areas and the outlet side end portion of the flow channel obtains a non-circular cross-section, which counteracts an efficiency-reducting twisting of the blown out flow. The mass production of such pipe sections is facilitated if the outlet cross-section of the flow channel in the corner areas is limited by segments of a surface of revolution coaxial to the rotor axis. The mould faces corresponding to these segments can then be shaped on the lathe.

These non-circular cross-sectional extensions of the diffuser channel into the corners of the casing appropriately first pass to the final portion (e.g. the last quarter) of the axial casing, considered in the flow direction.

The degree of development of this corner extension also determines the amount of the above mentioned so-called torque recovery (or reduction of said twisting) obtained therewith and improves the fan characteristics.

In the said construction, on the discharge side in each centre of the contour sides, the diffuser is sectionally undisturbed until in the outlet plane, from where there is a peripherally increasing widening (preferably in a monotonic manner) up to the two neighbouring corner areas.

According to a further development of the invention, the flow channel inlet is bounded by a polygonal contour, in whose corner areas the inlet end portion of the flow channel projects beyond the circular periphery circumscribed by the polygonal contour.

As a result of this further development, the inlet is further widened by a non-circular cross-section on the suction side and the flow into the fan is improved.

The polygonal contour on the suction or pressure sides in many cases is due to a built-in flange which there seals the pipe section in the peripheral direction and whose outermost corners project over the flow channel and can have fixing elements e.g. holes.

It is recommended to arrange each spoke opposite an associated corner area and to fix the same to the peripheral end of this corner area located in the direction of rotation at the edge of the pipe section. As a result, the noise caused by the spokes is minimal.

The electric motor is preferably an external rotor-type motor, whose rotor surrounds the stator.

These and further objects, features and advantages of the present invention will become more obvious from the following description with reference to the accompanying drawings, which show for purposes of illustration only several embodiments of the present invention.

BRIEF DESCRIPTION OF THE DRAWINGS

The invention is now explained with reference to the drawings, wherein show.

DETAILED DESCRIPTION OF THE PREFERRED EMBODIMENTS

FIGS. 1 and 6 to 9 are all in the scale 1:1 to the actual embodiment, whilst FIGS. 2 to 5 are shown in a scale 1:2.

Figure 6:
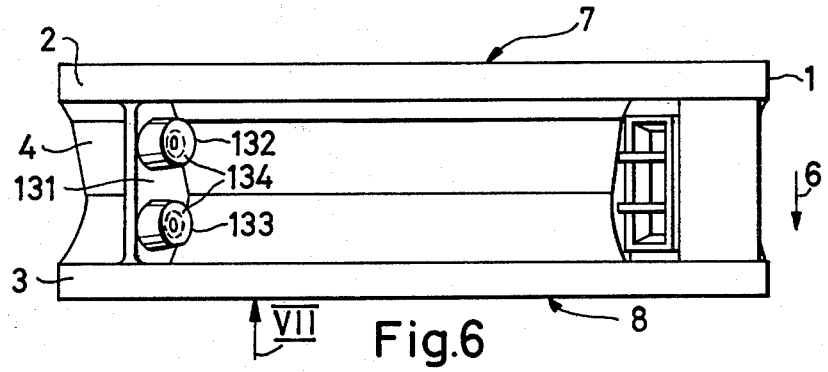

The fan casing 1 comprises two flanges 2 and 3 with a congruent square outer contour between which extends the pipe section 4, which surrounds the flow channel 5, whereby an operation flow takes place in the direction of the arrow 6 of FIG. 6. The suction side inlet of flow channel 5 is designated by the reference numeral 7 and the pressure side outlet by the reference numeral 8. The electrical driving motor is 62, being constructed as an external rotor-type motor. The stator is designated by 10 and the rotor by 11. On the periphery of rotor 11 are provided a total of five blades 12 to 16, which are made from metal and are welded as a set of rotor laminations 17. Rotor shaft 18 is mounted in rotary manner in the two pivot bearings 20, 21 so as to move in the axial direction shown by the double arrow 19 and on its suction side end is supported in a central punctiform bearing 22, which is fixed to a flanged wheel 23. Punctiform bearing 22 is made from a molybdanum-sulfide-containing plastic disk 222 and a felt disk 122 located thereunder and which is saturated with lubricant, whereby the rounded polished end of shaft 18 runned onto disk 222 with punctiform contact (Punctiform bearing). The flanged wheel 23 is positioned abreast of the suction side flange 3 and is fixed with four spokes 24 to 27 to the suction side edge 53 of pipe section 1. The spokes 24 to 27 extend over the axial surface of projection of fan blades 12 to 16, sloping relative to the suction side edges 28 of the blades, so that in the projection according to FIG. 1 for example, an outwardly open acute angle, indicated by double arrow 29, is formed between edge 28 and spoke 25. As a result, when the blades rotate in the direction of arrow 31, the axial projection of intersection points 30 of edges 69, 70 of spokes 25 with edge 28 is displaced radially outwardly in operation. The same applies for the other suction side blade edges and spokes.

The flow channel 5 tapers to a necked-down portion 32 whereon the pipe section 4 closely embraces the periphery of fan blades 12 to 16. From inlet 7, the cross-section of the flow channel 5 tapers with a continuously decreasing pitch in the manner of the inlet constriction of a Venturi tube. As from the necked-down portion 32, the flow channel widens in diffuser-like manner with an initially slight pitch over the diffuser section 33 and then with a more pronounced pitch over the second diffuser section 34. The suction side constriction 35, like the two diffuser sections 33, 34 is constructed as a surface of revolution, concentric to the fan axis 36.

Figure 1:
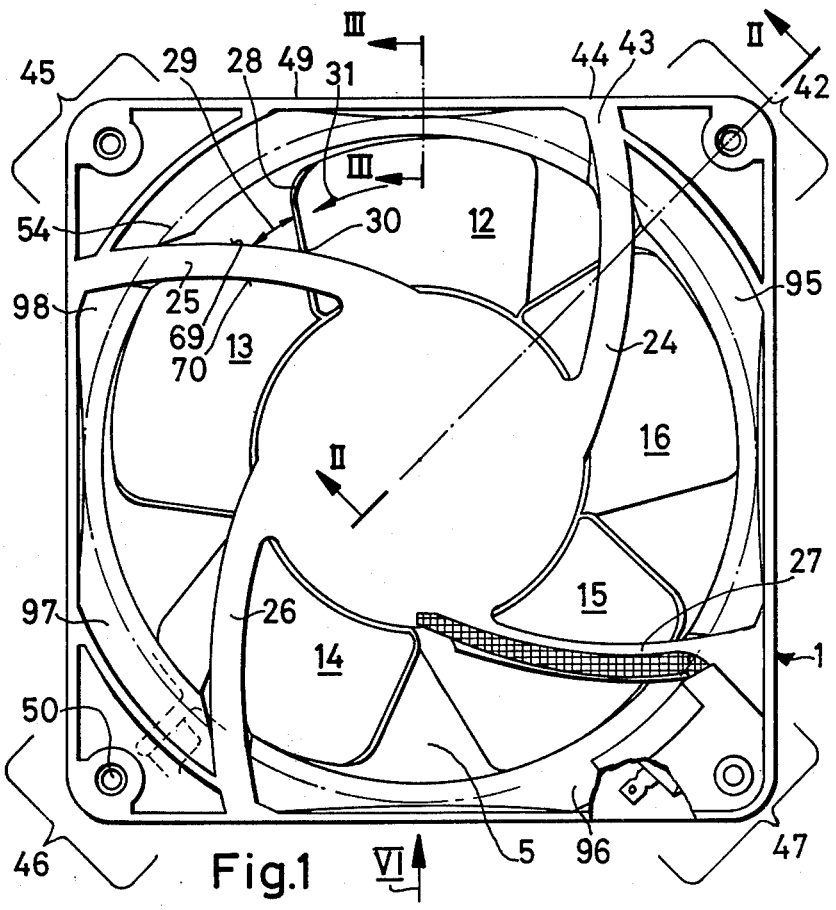
FIG. 1 is an embodiment of an axial fan according to the invention viewed in the direction of the inlet, FIG. 2 a partial section II—II of FIG. 1, FIG. 3 a partial section III—III of FIG. 1, representing the casing only, FIG. 4 a sectional representation according to FIG. 2, but with a smaller cutaway portion of a second embodiment, FIG. 5 a representation of the second embodiment corresponding to FIG. 3, FIG. 6 a view along the arrow VI of FIG. 1, FIG. 7 a view, which is turned counterclockwise by 90° in the drawing plane following the arrow VII in FIG. 6, whereby the lower right hand quarter shows the conditions of FIGS. 4 and 5, FIG. 8 a partial section according to arrows VIII—VIII of FIG. 7, FIG. 9 a partial section according to arrows IX—IX of FIG. 8.
Figure 2:
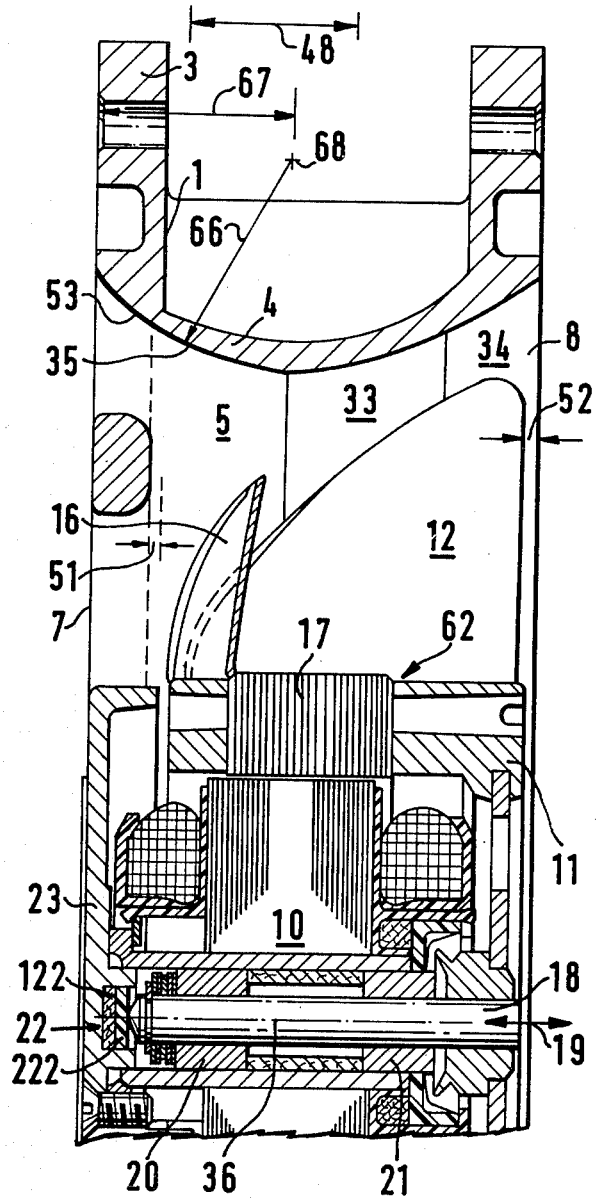
Figure 3:
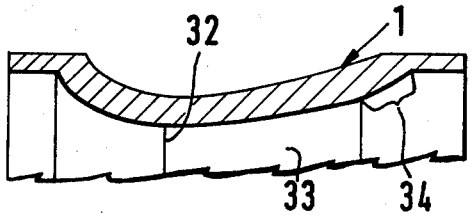

The sectional representation of FIG. 2 passes in each case through one corner area 42. As can be gathered from FIGS. 1 and 7, between the corner areas the flow channel is bounded on both the inlet and outlet sides by the edge of flanges 2 and 3, so that in these areas the second diffuser section 34 or the constriction 35 extends only up to the circular periphery 54, which is circumscribed by the square contour 49. In the corner areas 42, 45, 46, 47 however, the inlet side constriction 35 and the outlet side diffuser section 34 extend further and in the corner areas are formed segments 55, 56, 57, 58 of the secnd diffuser section 34, which project beyond the circular periphery 54. These segments are with the remaining portions of the second diffuser section 34, surfaces of revolution coaxial to the fan axis 36. The corresponding segments on the suction side are designated by 95 to 98 and form with the remaining portions of the suction side constriction 35, a common surface of revolution coaxial to the fan axis 36.

Figure 4:
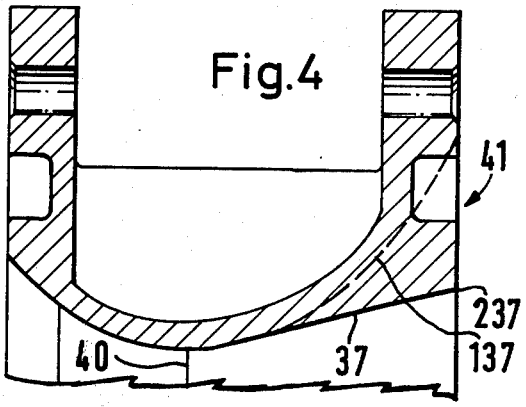
Figure 5:
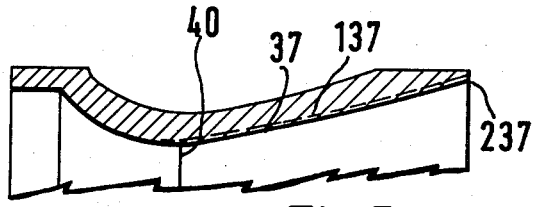
Figure 8:
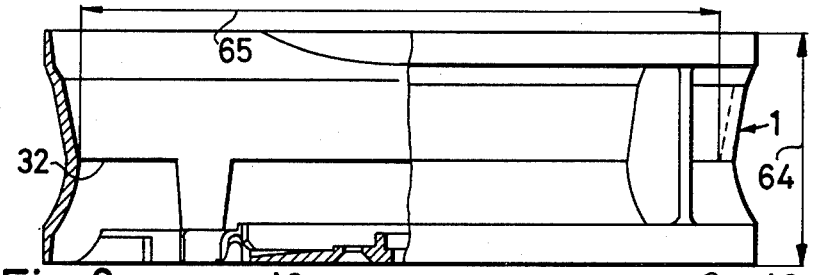

The second embodiment with a quasi undisturbed diffusor shown in cutaway portion in FIGS. 4 and 5 differs from the first embodiment only in that the pressure side diffusorlike extension 37, when located within the circumscribing square contour everywhere has the same pitch leading to the circular line 237 which defines the flow channel in the outlet plane 8. The dotted line 137 indicates a third embodiment having a very pronounced extension in the corner areas 42 (additionally to the second construction).

Figure 7:
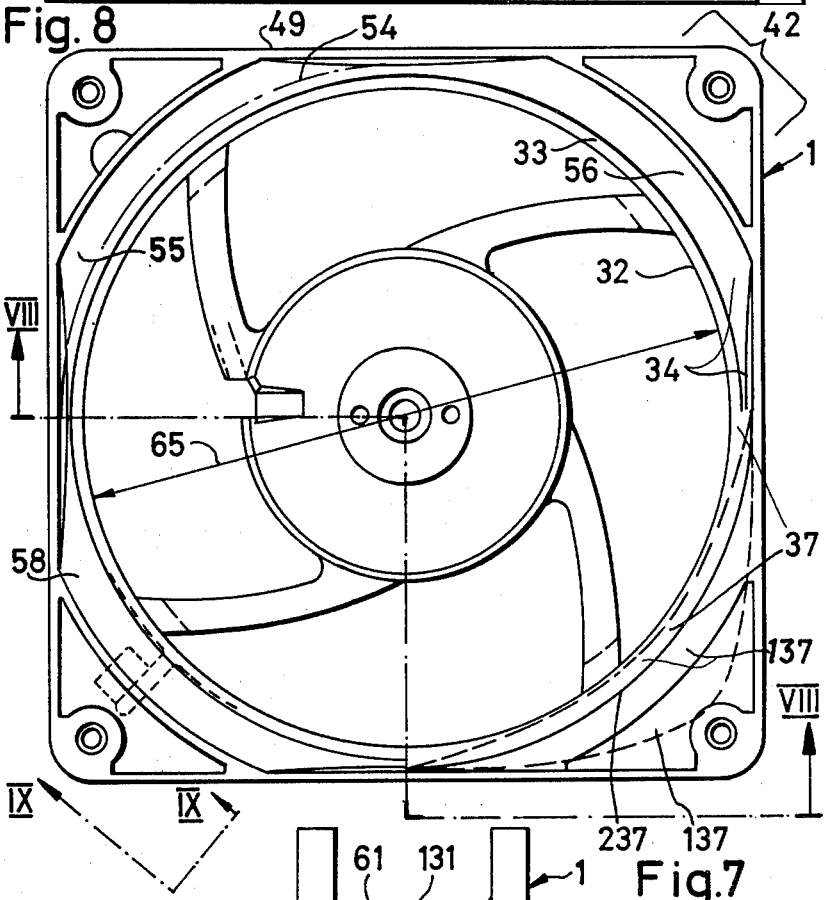

In FIG. 7, these two embodiments are shown at the bottom right. However, even in the case of this third variant shown by dotted line, centrally between the corner areas of the casing (centres of the contour side) the diffusor has a constant angle of divergence (c.f. reference 137 in FIGS. 4 and 5).

Spoke 24 faces corner area 42 and is fixed by its outer end 43 to the peripheral end 44 of corner area 42 located in the direction of rotation. The same applies to the remaining spokes 25, 26, 27, which face the remaining corner areas 45, 46, 47.

The fan blades 12 to 16 extend over the entire axial length of the flow channel taken up by the spokes 24 to 27, except for the small clearances 51, 52. The necked-down portion 32 is located within the suction side half of the axial extent of the fan blades, shown by double arrows 28 and has itself a minimal axial extension.

Holes, for example hole 50, are provided in the corners of flanges 2 and 3 extending over flow channel 5 and these are used for fixing the fan to a wall or the like where it is to be installed.

Hereinafter, a number of dimensions are given which are used relative to the embodiments of FIGS. 1 to 3 and 6 to 9, and which have proved advantageous in connection with a high fan efficiency and low noise.

The angle 29 should be as large as possible and is in the ideal case about 90°, which leads to a drastic noise reduction of about 4 dB.

The axial length following double arrow 64 is at a ratio of about 1:3 to the diameter according to the double arrow 65 in the area of necked-down portion 32. The radius according to arrow 66 constitutes about half the axial length according to double arrow 64 and the spacing between double arrow 67 of centre point 68 from inlet 7 is about 4/10 of the axial length according to double arrow 64. The aperture angle of the first diffuser section 33 is 22° and the aperture angle of the second diffuser section 34 about 40°. The axial length of the first diffuser section extends over about 55% of the axial length according to double arrow 64. The diffuser angle of the second diffuser section 34 can also for example be between 30 and 70%.

Figure 9:
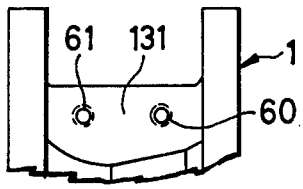

According to FIG. 9, tapped hole 60, 61 with different threads are provided on web plate 131 located on facing 1 for the purpose of screwing in screws designed according to different standards. An electrical earth wire can be screwed in with a single appropriate screw.

The specific embodiment of FIG. 6 shows the embodiment of FIG. 1 in greater detail and specifically externally on casing 1 in a depression in the area of a corner 46 within the casing contour alongside a mounting hole 50 with a plurality of parallel lugs 132, 133 which are fixed to a wall 131 and the latter is conductively fixed to the casing 1, e.g. by joining. In the common plane 134, which is perpendicular to the holes in lugs 132, 133 the faces of lugs 132, 133 are bare. The lugs have threads of differing systems or dimensions so that with a single casing type in store, it is possible by the arbitrary screwing-in of the particular authorised earthing screw at the point of use to satisfy the various national safety requirements in the different countries. Thus, e.g. 132 has a metric thread for European countries and 133 a thread measured in inches for the U.S.A. or Canada, as shown in FIG. 9 on the back of plate 131. This permits more rational storage and more flexible service. These differing threads may of course be situated anywhere in or on a fan housing, the latter being used on an axial, radial or mixed flow-type fan.

The invention is not limited to the embodiments described and represented hereinbefore, various modifications being possible thereto without passing beyond the scope of the invention.

What is claimed is:

1. An axial fan whose fan blades are fixed to the rotor of an electrical driving motor and are mounted coaxially within a pipe section and extend over at least half the axial length of the said pipe section, whereby the flow channel formed by the pipe section is constricted from a wide suction side inlet to a necked-down portion in the flow direction and from this necked-down portion is widened to a wide pressure side outlet, wherein the said necked-down portion closely embraces the periphery of the blades and extends only over a small fraction of the suction side axial length of the blades and wherein the shaft of a rotor is mounted with axial clearance in bearing means and is supported on the suction side on a punctiform bearing arranged centrally in flange means and wherein the flange means is fixed with spokes to the suction side edge of the pipe section, the said spokes spanning the annular axial surface of projection of the blades hollowed out by the flange means in an inclined manner relative to the suction side edges of the blades and specifically with such an orientation of the inclined position that the axial projection of the intersection points of the spokes with the edges is displaced outwardly in operation;

wherein the outlet of the flow channel is bounded by a polygonal contour, in whose corner areas the outlet end portion of the flow channel projects over the circular periphery circumscribed by the polygonal contour and the outlet cross-section of the flow channel is bounded in the corner areas by segments of a surface of revolution coaxial to the rotor axis.

2. An axial fan whose fan blades are fixed to the rotor of an elecrical driving motor and are mounted coaxially within a pipe section and extend over at least half the axial length of the said pipe section, whereby the flow channel formed by the pipe section is constricted from a wide suction side inlet to a necked-down portion in the flow direction and from this necked-down portion is widened to a wide pressure side outlet, wherein the said necked-down portion closely embraces the periphery of the blades and extends only over a small fraction of the suction side axial length of the blades and wherein the shaft of a rotor is mounted with axial clearance in bearing means and is supported on the suction side on a punctiform bearing arranged centrally in flange means and wherein the flange means is fixed with spokes to the suction side edge of the pipe section, the said spokes spanning the annular axial surface of projection of the blades hollowed out by the flange means in an inclined manner relative to the suction side edges of the blades and specifically with such an orientation of the inclined position that the axial projection of the intersection points of the spokes with the edges is displaced outwardly in operation;

wherein the outlet and inlet of the flow channel are bounded by the same polygonal contour, in whose corner areas the inlet side end portion and the outlet side end portion of the flow channel project beyond the circular periphery circumscribed by the polygonal contour and the outlet cross-section is bounded in the corner areas by segments of a surface of revolution coaxial to the rotor axis.

3. An axial fan comprising an electrical driving motor having a rotor;

plurality of fan blades secured to said rotor; and a channel section forming an axial flow channel, said motor and said fan blades being mounted within said channel section, said flow channel having a wide suction inlet end narrowing down to a necked-down constricted portion and thereafter widening from said constricted portion to a wide pressure outlet end along the entire inner periphery of said channel section, said constricted portion being closely adjacent to said fan blades at only a small fractional portion of the suction side of the blades, the major portion of the fan blades being downstream of said constricted portion in the flow direction.

4. An axial fan according to claim 3, wherein said flow channel widens at the outlet end from said necked-down constricted portion into a first diffuser region and thereafter further widens into a second diffuser region, and wherein said fan blades extend downstream into said second diffuser region.

5. An axial fan comprising:

an electrical driving motor having a rotor;

plurality of fan blades secured to said rotor;

a channel section forming an axial flow channel, said motor and said fan blades being mounted within said channel section, said flow channel having a wide suction inlet end narrowing down to a necked-down constricted portion and thereafter widening from said constricted portion to a wide pressure outlet end along the entire inner periphery of said channel section, and wherein the outlet end of the flow channel is bounded by a polygonal contour with corner areas, said pressure outlet end projecting beyond the circular periphery circumscribed by the polygonal contour of said corner areas, wherein said constricted portion and said widening portion are closely adjacent to said fan blades, said fan blades being of a greater radial length in said widening portion than in said constricted portion.

6. An axial fan according to claim 5, wherein said fan structure has an axial dimension which is compact relative to its radial dimensions.

7. An axial fan according to claim 5, wherein more than half of the fan blades are downstream of said constricted portion in the flow direction.

8. An axial fan according to claim 7, wherein said flow channel widens at the outlet end from said necked-down constricted portion into a first diffuser region and thereafter further widens into a second diffuser region, and wherein said fan blades extend downstream into said second diffuser region.

9. An axial fan comprising an elecrical driving motor having a rotor;

plurality of fan blades secured to said rotor;

a channel section forming an axial flow channel, said motor and said fan blades being mounted within said channel section, said flow channel having a wide suction inlet end narrowing down to a necked-down constricted portion and thereafter widening from said constricted portion to a wide pressure outlet end along the entire inner periphery of said channel section, wherein said constricted portion is closely adjacent to said fan blades, and extends only over a small fractional portion of the suction side axial length of said blades, and wherein the outlet end of the flow channel is bounded by a polygonal contour with corner areas, said pressure outlet end projecting beyond the circular periphery circumscribed by said polygonal contour at said corner areas.

10. An axial fan according to claim 9, wherein flange means having spokes fixed at said flow channel are provided for mounting said motor.

11. An axial fan according to claim 10, wherein said spokes span the annular space of said flow channel, and said spokes are inclined relative to suction end edges of said fan blades at an orientation such that the axial projection of the intersection points of said spokes with the blade edges is displayed outwardly during operation of the fan.

12. An axial fan according to claim 9, wherein the outlet end and the inlet end of the flow channel are both bounded by the same polygonal contour with said corner areas, said suction inlet end and said pressure outlet end of the flow channel projecting beyond the circular periphery circumscribed by the polygonal contour at said corner areas.

13. An axial fan according to claim 9, wherein the pressure outlet end extension of the flow channel widens in the manner of a diffuser.

14. An axial fan according to claim 9, wherein said flow channel widens at the outlet end from said necked-down constricted portion into a first diffuser region and thereafter further widens into a second diffuser region, and wherein said fan blades extend downstream into said second diffuser region.

15. An axial fan comprising an electrical driving motor having a rotor;

plurality of fan blades secured to said rotor;

a channel section forming an axial flow channel, said motor and said fan blades being mounted within said channel section, said flow channel having a wide suction inlet end narrowing down to a necked-down constricted portion and thereafter widening from said constricted portion to a wide pressure outlet end along the entire inner periphery of said channel section, said constricted portion being closely adjacent to said fan blades at only a small fractional portion of the suction side of the blades, the major portion of the fan blades being downstream of said constricted portion in the flow direction, and flange means for mounting said motor and having spokes fixed at said suction inlet end of said flow channel, said spokes spanning the annular space of said flow channel, and said spokes being inclined relative to suction end edges of the fan blades at an orientation such that the axial projection of the intersection points of said spokes with the blade edges is displaced outwardly during operation of fan;

wherein the outlet end of the flow channel is bounded by a polygonal contour with corner areas, said pressure outlet end projecting beyond the circular periphery circumscribed by said polygonal contour at said corner areas.

16. An axial fan according to claim 15, wherein the cross-section at the pressure outlet end of the flow channel is bounded in the corner areas by segments of a surface of revolution coaxial to the rotor axis.

17. An axial fan according to claim 15, wherein the inlet end of the flow channel is bounded by said polygonal contour having said corner areas, said suction inlet end of the flow channel projecting beyond the circular periphery circumscribed by the polygonal contour at said corner areas.

18. An axial fan according to claim 15, wherein the outlet end and the inlet end of the flow channel are both bounded by the same polygonal contour with said corner areas, said suction inlet end and said pressure outlet end of the flow channel projecting beyond the circular periphery circumscribed by the polygonal contour at said corner areas.

19. An axial fan according to claim 15, wherein the outlet end and the inlet end of the flow channel are both bounded by the same polygonal contour with said corner areas, said suction inlet end and said pressure outlet end of the flow channel projecting beyond the circular periphery circumscribed by the polygonal contour at said corner areas, and wherein the cross-section at the pressure outlet end is bounded in the corner areas by segments of a surface of revolution coaxial to the rotor axis.

20. An axial fan according to claim 15, wherein the inlet end of the flow channel is bounded by said polygonal contour with corner areas, said suction inlet end of the flow channel projecting beyond the circular periphery circumscribed by the polygonal contour at said corner areas, and wherein each spoke is arranged opposite an associated corner area with a peripheral end of the associated corner area being fixed to the edge of the channel section in the direction of rotation of said rotor.

21. An axial fan according to claim 15, wherein the constriction of the flow channel at the suction side of the fan blades has a pitch which continuously decreases in the flow direction.

22. An axial fan according to claim 15, wherein the pressure outlet end extension of the flow channel widens in the manner of a diffuser.

23. An axial fan according to claim 15, wherein the constriction of the flow channel at the suction side of the fan blades has a continuously decreasing pitch in the flow direction, and wherein the pressure outlet end extension of the flow channel widens in the manner of a diffuser.

24. An axial fan according to claim 15, wherein the rotor includes an external-type rotor surrounding the stator of the electric motor.

25. An axial fan according to claim 15, wherein said electric motor has a rotor shaft supported at the suction inlet end of the flow channel by a punctiform bearing arranged centrally in said flange means.

26. An axial fan according to claim 25, wherein the cross-section at the pressure outlet end of the flow channel is bounded in the corner areas by segments of a surface of revolution coaxial to the rotor axis.

27. An axial fan according to claim 25, wherein the rotor includes an external-type rotor surrounding the stator of the electric motor.

28. An axial fan according to claim 25, wherein said rotor shaft is mounted with axial clearance in pivot bearings.

29. An axial fan according to claim 28, wherein the cross-section at the pressure outlet end of the flow channel is bounded in the corner areas by segments of a surface of revolution coaxial to the rotor axis.

30. An axial fan according to claim 28, wherein the rotor includes an external-type rotor surrounding the stator of the electric motor.

* * * * *